US010822780B2

(12) United States Patent
Sumner et al.

(10) Patent No.: US 10,822,780 B2
(45) Date of Patent: Nov. 3, 2020

(54) PLUMBING ASSEMBLY

(71) Applicant: Lake Products Limited, Rosedale, Auckland (NZ)

(72) Inventors: Michael John Sumner, Hillcrest (NZ); Andrew Leo Haynes, Hibiscus Coast (NZ); Gabriel Ioan Giurgiu, Glenfield (NZ)

(73) Assignee: Lake Products Limited, Rosedale (NZ)

( * ) Notice: Subject to any disclaimer, the term of this patent is extended or adjusted under 35 U.S.C. 154(b) by 146 days.

(21) Appl. No.: 14/273,913

(22) Filed: May 9, 2014

(65) Prior Publication Data

US 2014/0331404 A1 Nov. 13, 2014

(30) Foreign Application Priority Data

May 9, 2013 (NZ) ..... 610407

(51) Int. Cl.
*E03C 1/28* (2006.01)
*E03C 1/292* (2006.01)

(52) U.S. Cl.
CPC ..... *E03C 1/28* (2013.01); *E03C 1/292* (2013.01)

(58) Field of Classification Search
CPC .. E03C 1/28; E03C 1/284; E03C 1/292; F16L 27/11; Y10S 4/16
USPC ..... 4/679, DIG. 16; 285/226
See application file for complete search history.

(56) References Cited

U.S. PATENT DOCUMENTS

| | | | | | |
|---|---|---|---|---|---|
| 213,831 | A * | 4/1879 | McBee | E03C 1/284 | 137/247.27 |
| D231,930 | S * | 6/1974 | Danks | 4/DIG. 16 | |
| 3,967,324 | A * | 7/1976 | Olive | E03C 1/284 | 137/247.41 |
| 4,081,190 | A | 3/1978 | Itzler | | |
| 4,165,110 | A | 8/1979 | Itzler | | |
| 4,846,510 | A * | 7/1989 | Mikol | F16L 27/11 | 138/121 |
| 2005/0178438 | A1* | 8/2005 | Renner | F16L 55/24 | 137/247.41 |

(Continued)

FOREIGN PATENT DOCUMENTS

| | | |
|---|---|---|
| JP | 08-060723 | 3/1996 |
| JP | 08-093024 | 4/1996 |

(Continued)

OTHER PUBLICATIONS

Examination Report for New Zealand Patent Application No. 624764, dated May 26, 2014, 2 pages.

*Primary Examiner* — David P Angwin
*Assistant Examiner* — William R Klotz
(74) *Attorney, Agent, or Firm* — Foley & Lardner LLP

(57) ABSTRACT

The present invention relates to a plumbing assembly for connecting a discharge connection of a fixture to a waste outlet, the assembly comprising a substantially rigid conduit trap portion (whether the trap portion forms a part of an S, P, U or J shaped conduit bend). The rigid conduit trap portion including an inlet and an outlet, and a substantially conformable or flexible conduit portion connectable to the rigid conduit trap portion at either of i) the rigid conduit trap inlet, or ii) the rigid conduit trap outlet. The rigid conduit trap portion and conformable or flexible conduit portion when assembled providing for a complete trap assembly.

11 Claims, 6 Drawing Sheets

(56) References Cited

U.S. PATENT DOCUMENTS

| | | | | |
|---|---|---|---|---|
| 2010/0024120 | A1* | 2/2010 | Coronado | E03C 1/20 4/679 |
| 2011/0277232 | A1* | 11/2011 | Shilo | E03C 1/12 4/679 |
| 2013/0284301 | A1* | 10/2013 | Chen | F16L 11/112 138/109 |

FOREIGN PATENT DOCUMENTS

| | | |
|---|---|---|
| JP | 2002-167825 | 6/2002 |
| JP | 2006-328758 | 12/2006 |
| WO | WO-2009/122292 | 10/2009 |

* cited by examiner

PLUMBING ASSEMBLY

FIELD OF THE INVENTION

The present invention relates to a plumbing assembly and/or components for a plumbing assembly, more particularly though not solely, to a plumbing assembly for connecting a discharge connection of a fixture to a waste outlet with the formation of a water seal, such as a trap.

BACKGROUND TO THE INVENTION

In various situations, plumbing assemblies require the implementation of a liquid seal, typically via the use of a liquid weir provided by the configuration of plumbing into a trap. Such a liquid seal provided by a trap provides a number of known benefits to those skilled in the art, as well as the home handy man.

However, the particular location of a trap often presents difficulties during installation, or when a trap is to be retrofitted to a plumbing configuration. It would therefore be advantageous to provide for a system which enables formation of a suitable trap configuration (i.e. can provide for a weir of certain liquid sealing height), yet which provides for a less complicated installation.

Further, provision of components which when assembled provide for a trap, yet are capable of being fitted or installed in difficult spaces which would otherwise not accommodate traditional plumbing fittings or conduit would be advantageous.

It is therefore an object of the present invention to provide a plumbing assembly which provides for a trap or a plumbing assembly for connecting a discharge connection of a fixture to a waste outlet and/or which will go at least some way towards addressing the foregoing problems or which will at least provide the industry and/or public with a useful choice.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

Further aspects and advantages of the present invention will become apparent from the ensuing description which is given by way of example only.

SUMMARY OF THE INVENTION

In a first aspect, the present invention may broadly consist in a plumbing assembly for connecting a discharge connection of a fixture to a waste outlet, the assembly comprising:

a substantially rigid conduit trap portion (whether the trap portion forms a part of an S, P, U or J shaped conduit bend), the rigid conduit trap portion including an inlet and an outlet, and a substantially conformable or flexible conduit portion connectable to the rigid conduit trap portion at either of:

i. the rigid conduit trap inlet, or ii. the rigid conduit trap outlet, wherein the rigid conduit trap portion and conformable or flexible conduit portion when assembled provide for a complete trap assembly (whether as the S, P, U or J shaped trap).

Preferably the conformable or flexible conduit portion comprises a first end and a second end, one of said ends connectable to said rigid conduit trap portion and the other of said ends connectable to a further plumbing fixture or fitting. More preferably, the first end (or alternatively the second end) defines an inlet to the conformable or flexible conduit portion, and the second end (or in the alternative, the first end) defines an outlet from the conformable or flexible conduit portion.

Preferably the conformable or flexible conduit portion has a pre-determined maximum bending capability or a maximum bendable state, such that the pre-determined maximum bending capability or bendable state defines at a bend an inner radius that is at the conformable or flexible conduit's maximum compressible state. Alternatively, is at the conformable or flexible conduit's maximum extension state (when considered with respect to the outer of the bend, rather than the inner of the bend as indicated by numeral 9).

Preferably said rigid conduit trap portion provides for at least a part of a whole trap, and wherein said conformable or flexible conduit is at least one or more of conformed or bent or shaped or flexed to provide the remainder of a desired trap configuration or shape.

Preferably said desired trap configuration or shape is an S, P, U or J trap.

Preferably the complete trap when assembled provides a weir height or available liquid seal or sealing height (i.e. the trap) which is of a pre-determined height, for example a height which meets or achieves at least the minimum regulation.

Preferably assembly of said rigid conduit trap portion and said conformable or flexible conduit portion provide for a trap with an achieved weir of sufficient height for a pre-determined or particular application.

Preferably, or alternatively, assembly achieves a trap for a liquid weir height meeting minimum liquid seal height regulations.

Preferably said weir height is at least a depth of seal of about 50 mm (±5 mm), or at least about 70 mm (±5 mm), or at least about 75 mm (±5 mm). More preferably, said weir height is a depth of seal of more than about 40 mm, or more than about 50 mm, or more than about 60 mm, or more than about 70 mm.

Preferably said conformable or flexible conduit portion comprises at each of said first and second ends a substantially rigid connection member for connection to said further plumbing fixtures or fitting.

Preferably said rigid connection member is one or more of: a threaded connector, a push-fit connector, a friction-fit connector. More preferably, said rigid connection member includes an insert for receiving a conduit in a sealing manner.

Preferably said conformable or flexible conduit portion is of a concertina-type construction, capable of extending in length from a compressed length state to a longer extended length state.

Alternatively, or preferably, the conformable or flexible conduit portion comprises a reinforcing material or structure, such that the conduit may be conformed to a desired shape, more preferably, the desired shape may be retained by the conduit once conformed or flexed to a desired shape or position.

In yet further embodiments, the conformable or flexible conduit may be a smooth walled conduit (i.e. does not need to be of a concertina type or bellows or of a helically wound configuration).

In a second aspect, the present invention may broadly consist in a conformable or flexible conduit portion comprising at a first end a first coupling for connection to a first plumbing fitting or fixture, and at a second end a second coupling for connection to a partial trap portion, at either of:

an inlet to the partial trap portion, or an outlet to the partial trap portion.

Preferably said first and second couplings are a rigid connection member.

Preferably said first and second couplings is/are one or more of: a threaded connector, a push-fit connector, a friction-fit connector.

Preferably the conformable or flexible conduit portion has a pre-determined maximum bending capability or a maximum bendable state, such that the pre-determined maximum bending capability or bendable state defines at a bend an inner radius that is at the conformable or flexible conduit's maximum compressible state. Alternatively, is at the conformable or flexible conduit's maximum extension state (when considered with respect to the outer of the bend, rather than the inner of the bend as indicated by numeral 9).

Preferably said conformable or flexible conduit portion is of a concertina-type construction, capable of extending in length from a compressed length state to a longer extended length state.

Alternatively, or preferably, the conformable or flexible conduit portion comprises a reinforcing material or structure, such that the conduit may be conformed to a desired shape, more preferably, the desired shape may be retained by the conduit once conformed or flexed to a desired shape or position.

In yet further embodiments, the conformable or flexible conduit may be a smooth walled conduit (i.e. does not need to be of a concertina type or bellows or of a helically wound configuration).

Preferably said conformable or flexible conduit portion is assembled to a substantially rigid partial trap portion to form a complete or whole trap as part of a plumbing assembly.

In a third aspect, the present invention may broadly consist in a connection member for connection with an end of a substantially conformable or flexible conduit, comprising a sleeved fitting for receiving an end section of the substantially conformable or flexible conduit, the sleeved fitting region configured to retain the end section, and said sleeved fitting further comprising a substantially rigid connector for connecting to a fitting or fixture.

Preferably, the conformable or flexible conduit is a concertina or extendible length flexible conduit.

Preferably the connector comprises an extended portion protruding from the sleeved fitting, said extended portion including the connector.

Preferably the connector is one or more of: a threaded connector, a push-fit connector, a friction-fit connector.

Preferably the extended portion extends away from the end of the substantially conformable or flexible conduit.

Preferably the extended portion provides for the connector for connecting to a fitting or fixture to be located internally of an end section of the conformable or flexible conduit.

Preferably an inside or inner surface of the sleeved fitting is provided with connector for connecting to a fitting or fixture.

Preferably the sleeved fitting is a moulded member comprising a thread for threaded engagement with a further fitting or fixture, and the sleeved fitting seals to an end section of the conformable or flexible conduit.

In a fourth aspect, the present invention may broadly consist in a plumbing assembly for connecting a discharge connection of a fixture to a waste outlet, the assembly including a conduit comprising:

a first portion, the first portion comprising:

an entry, an outlet, operable to retain a body of water between the entry and outlet, the entry adapted to connect to the discharge of the fixture, and a second portion, the second portion comprising:

an entry, an outlet, the entry adapted to connect to the outlet of the first portion, the outlet adapted to connect to the waste outlet.

In a fifth aspect, the present invention may broadly consist in a plumbing assembly for connecting a discharge connection of a fixture to a waste outlet, the assembly comprising:

a trap, comprising:

an entry, an outlet, operable to retain a body of water between the trap entry and trap outlet, the entry adapted to connect to the discharge of the fixture, and a conduit, comprising:

an entry, an outlet, the entry adapted to connect to the outlet of the trap, the outlet adapted to connect to the waste outlet.

According to either of the fourth or fifth aspects above, the following preferred features may be provided.

Preferably the plumbing assembly comprises an internal passage operable to provide a fluid passage from the fixture to the waste outlet.

Preferably the internal passage is operable to maintain a minimum cross sectional area, where the plumbing assembly comprises a substantially continuous bore operable to provide a fluid passage from the fixture to the waste outlet.

Preferably the conduit comprises a flexible hose.

Preferably the conduit comprises a hose operable to resiliently maintain a desired a shape or geometry.

Preferably the conduit has a geometry arranged during connection between the outlet of the trap and the waste outlet and is substantially resilient to changes in that geometry.

Preferably the conduit comprises corrugations or a bellows-like form.

Alternatively, the conduit is such that may be conformed to a shape or position and which may retain that conformation or shaping or positioning. Preferably, such a conduit is that which is able to be conformed to achieve a desired shape or configuration which when coupled or assembled with a rigid component can together form a whole trap assembly.

Preferably the conduit is adapted to be compressed, stretched or otherwise contorted or bent into a desired shape or geometry and/or to substantially conform to a desired shape or geometry.

Preferably the conduit is adapted to substantially resiliently maintain a desired shape formed when connected to the trap and the waste outlet.

Preferably the conduit comprises plurality of axially spaced annular rings.

Preferably the axial spacing of the annular rings bestows a minimum bend radius.

Preferably the minimum bend radius is operable to provide a substantially vertical or upright height.

Preferably the vertical or upright height is operable to retain a body of water.

Preferably the vertical or upright height is at least a minimum a height required for a particular application or to meet a minimum regulation of height for an application.

Preferably the annular rings extend radially, either external to the conduit, internal to the conduit, or both.

Preferably the conduit comprises at least one reinforcing structure.

Preferably the reinforcing structure extends radially, either external to the conduit, internal to the conduit, or both.

Preferably the reinforcing structure is helically wound about conduit, either external to the conduit, internal to the conduit, or both.

Preferably the conduit comprises a rigid portion extending from the conduit entry.

Preferably the conduit comprises a rigid portion extending from the conduit exit.

Preferably the trap and the rigid portion extending from the conduit entry are operable to retain at least a minimum height of water required for a particular application.

Preferably the trap comprises a rigid pipe/hose/conduit.

Preferably the trap comprises or is at least one of a: U, J, P or S shape bend.

Preferably the trap is operable to resiliently maintain a desired a shape or geometry.

Preferably the trap comprises a rigid and substantially vertically or upright orientated tube or conduit proximate the trap outlet.

Preferably the trap outlet comprises a rigid and substantially vertically or upright orientated tube or conduit section.

Preferably the trap outlet is operable to connect with the conformable or flexible conduit.

Preferably the trap rigid and substantially vertically or upright orientated conduit defines a substantially vertically or upright orientated portion of the conformable or flexible conduit proximate the connection to the trap outlet.

Preferably the substantially vertically or upright orientated tube or conduit and the substantially vertically or upright orientated portion of the conformable flexible conduit are operable to retain at least a desired minimum height of water.

Preferably the assembly further comprises a former adapted for insertion within the conduit.

Preferably the assembly further comprises a former adapted to surround the conduit.

Preferably the former is operable to resiliently maintain a desired a shape or geometry of at least a portion of the conduit.

Preferably the former is operable to resiliently maintain a desired minimum bend radius to at least a portion of the conduit, Preferably the trap entry comprises a sealable connection, such as a liquid sealable connection.

Preferably the trap outlet comprises a sealable connection.

Preferably the conduit entry comprises a sealable connection operable to connect to the trap outlet, Preferably the conduit exit comprises a sealable connection.

Preferably the sealable connection on either the trap entry, trap exit, or both, comprises a threaded surface operable to connect to another threaded surface.

Preferably the sealable connection on either the conduit entry, conduit exit, or both, comprises a threaded surface operable to connect to another threaded surface.

Preferably the sealable connection on the trap outlet is operable to connect to the sealable connection on the conduit entry.

Preferably the assembly further comprises a collar operable to enclose the sealable connection.

According to the above preferred features, in a sixth aspect, the present invention may broadly consist in a plumbing assembly for connecting a discharge connection of a fixture to a waste outlet, the assembly comprising:

a rigid conduit portion operable to receive water from the fixture and provide a water trap, and a conformable or flexible conduit portion operable to fluidly couple water from the rigid conduit portion to the waste outlet, wherein the conformable or flexible conduit portion is adapted to flex to form a shape when installed and be resilient to changes in that shape caused by internal water flow.

Preferably the rigid portion is operable to retain at least a portion of a pre-determined height of water, for example a portion of a total height of water that would otherwise need to be achieved or provided to meet a minimum regulation height according to a particular application (the conformable or flexible conduit portion providing the remainder of the necessary total height of water needed).

Preferably the rigid portion and the flexible portion are operable to provide or at least retain at least a pre-determined height of water, for example a height of water that achieves or meets a minimum regulation height according to a particular application.

Preferably the rigid portion comprises an upward orientated section operable to connect with the conformable or flexible portion.

Preferably the conformable or flexible portion has a minimum bend radius. Alternatively, when at the conformable or flexible conduit's maximum extension state (when considered with respect to the outer of the bend, rather than the inner of the bend as indicated by numeral 9), there is provided a maximum bend radius with which the conduit is capable of being bend or conformed.

Preferably the upward orientated section of the rigid portion and the minimum (or maximum) bend radius of the conformable flexible portion are operable to retain at least a pre-determined height of water.

According to the above preferred features, in another aspect, the present invention may broadly consist in a plumbing assembly for connecting a discharge connection of a fixture to a waste outlet, the assembly comprising:

a rigid member having a substantially U-shaped form and operable to receive water or liquid waste from the fixture, the rigid member comprising a first upward going portion operable to receive water or liquid waste from the discharge connection, a second lower portion operable to retain the water or liquid waste and a third upward going portion operable to discharge the water or liquid waste, and a conformable or flexible conduit portion operable to fluidly couple the water or liquid waste from the rigid member to the waste outlet.

Preferably at least the third portion and the conformable or flexible conduit are operable to provide or at least retain at least a pre-determined height of water or liquid waste, for example a height of water that achieves or meets a minimum regulation height according to a particular application.

Preferably the conformable or flexible conduit has a minimum bend radius such that, when at least partly orientated upright, provides, in conjunction with at least the third portion of the rigid member, a trap operable to retain at least a pre-determined height of water or liquid waste. Alternatively, when at the conformable or flexible conduit's maximum extension state (when considered with respect to the outer of the bend, rather than the inner of the bend as indicated by numeral 9), there is provided a maximum bend radius with which the conduit is capable of being bend or conformed.

For the purposes of this specification, reference to a "trap" also encompasses, but is not strictly limited to, waste traps or gully traps or other liquid outlets requiring of a liquid seal or liquid trap downstream so as to prevent gas or air from travelling back up the conduit or plumbing fittings to the liquid source. In addition, this invention may have application to any system requiring of a trap, for example plumbing applications (residential, commercial, or industrial, including automotive, aircraft or other specific applications, such as air conditioning plumbing arrangements).

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

The following description is provided with reference, though not solely, to the accompany figures.

The present invention aims to provide an easier and simplified system for formation of a trap assembly, particularly for a do-it-yourself installer or user, although provision of this invention may also greatly assist more advanced installers of plumbing components and assemblies (e.g. refrigeration or air-conditioning or plumbing installers or installation applications).

Provision of an assembly of a rigid trap component and a separate conformable or flexible trap component, which when these components are assembled together form a whole or complete trap assembly, allow for an arrangement where the conformable or flexible component can be more easily manipulated to fit into a tight or difficult shaped space (e.g. under a sink). Yet, the conformable or flexible conduit component allows for the achieving of a suitable trap with a minimum weir height or available height of for a liquid seal. Traditional rigid plumbing components often require holes to be cut in walls or the space where the trap is to be placed—this can be undesirable or not possible. Therefore, provision of a system which allows for a trap to be formed, yet which is not particular in being fitted in or to a particular space is advantageous.

Figure 1:
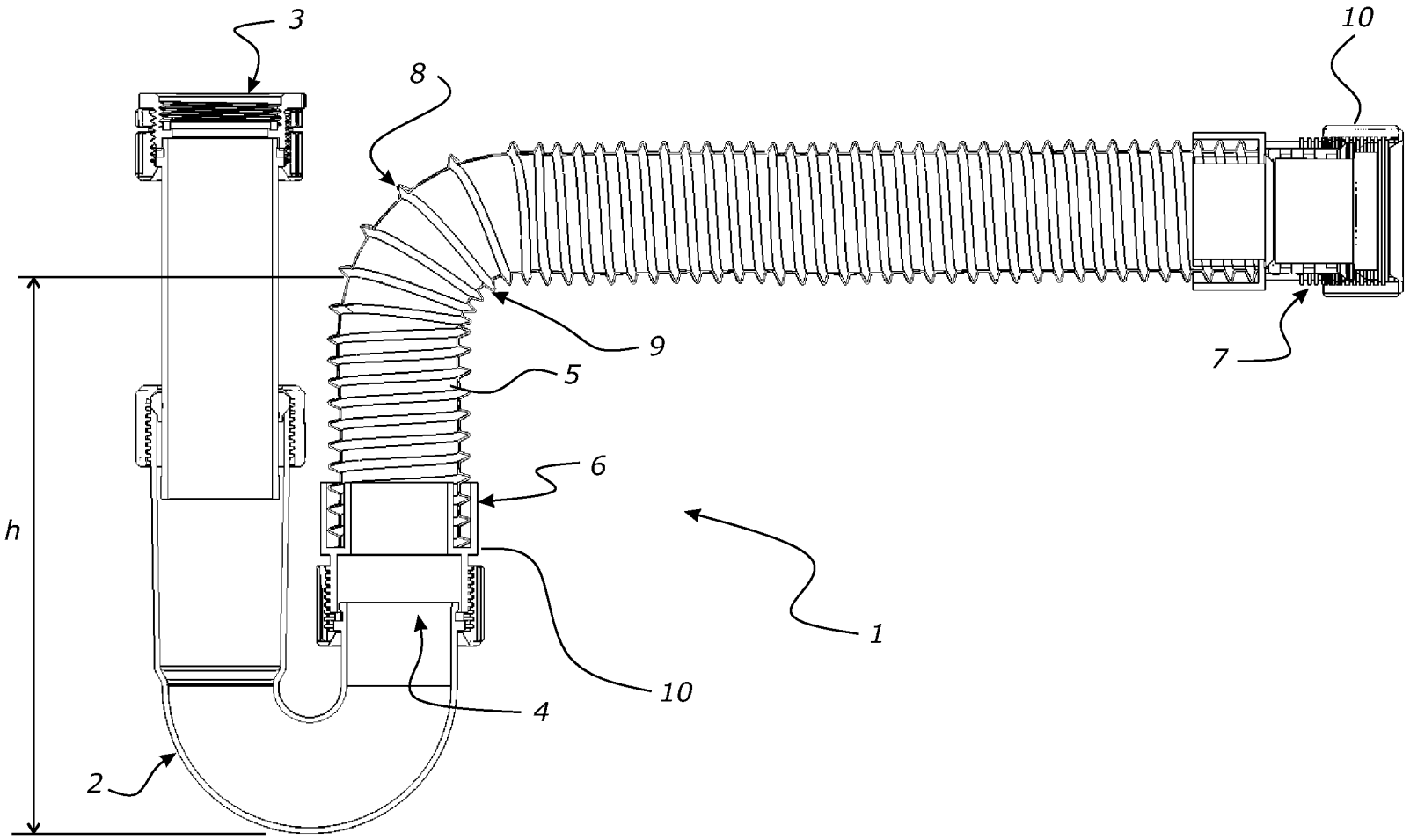
FIGS. 1 and 2 illustrate a first embodiment of the invention, with rigid components of the trap shown in section view, such an arrangement known as a P-type trap, FIG. 1 shown with a corrugated type conformable or flexible conduit, and FIG. 2 shown with a non-corrugated type conduit

As shown for example in FIG. 1 (as well as the other figures), there is provided a plumbing assembly 1 for connecting a discharge connection (not shown) of a fixture (not shown) to a waste outlet (not shown). The assembly 1 comprises a substantially rigid conduit trap portion 2 (whether the trap portion forms a part of an S, P, U or J shaped conduit bend), the rigid conduit trap portion 2 including an inlet 3 and an outlet 4. A substantially conformable or flexible conduit portion 5 is connectable to the rigid conduit trap portion 2 at either of i) the rigid conduit trap inlet 3, or ii) the rigid conduit trap outlet 4. The rigid conduit trap portion 2 and conformable or flexible conduit portion 5 when assembled together provide for a complete trap assembly (whether as the S, P, U or J shaped trap).

The conformable or flexible conduit portion 5 comprises a first end, such as that identified as item 6, and a second end, such as that identified as item 7, one of the ends (such as 6) connectable to the rigid conduit trap portion 2 and the other of the ends (such as 7) provided so as to be connectable to a further plumbing fixture or fitting. It will be appreciated that the identified first end 6 (or alternatively the second end 7) can define an inlet to the conformable or flexible conduit portion, and the second end 7 (or in the alternative, the first end 6) can define an outlet from the conformable or flexible conduit portion.

In a preferred embodiment, the conformable or flexible conduit portion 5 has a pre-determined maximum bending capability or a maximum bendable state. This capability or state defines at a bend 8 an inner radius 9 that is at the conformable or flexible conduit's maximum compressible state. That is, the conformable or flexible conduit is not able to bend or be bent any further, for example without structural collapse of the conduit or other structural failure. It will be appreciated that a more conformable or more flexible conduit will allow for greater conformability or flexibility and more complex trap configurations may be managed. In the alternative, less conformable or less flexible conduit may be used, so long as there is sufficient conformability or flexibility that allows for a desired trap shape or configuration to be achieved.

As shown by the figures, in this invention there is provided the rigid conduit trap portion 2 that provides for at least a part of a whole trap, and where the conformable or flexible conduit 5 provides for the remainder of the trap for forming of a whole trap. The conformable or flexible conduit 5 being at least conformed or bent or otherwise shaped or flexed to provide the remainder of the desired trap configuration or shape.

Various desired trap configuration or shapes can be achieved, for example the generalised arrangements known as S, P, U or J traps may be particularly preferred, although it will be appreciated other trap configurations may be shaped as necessary.

The complete or whole trap when assembled provides a weir height or available liquid seal height (h) (i.e. the trap) which is of a pre-determined height, for example a height which meets or achieves at least the minimum regulation for a particular application. For example, a weir height can be provided which has a depth of seal (h) of at least about 50 mm (±5 mm), or at least about 70 mm (±5 mm), or at least about 75 mm (±5 mm), yet further, weir height provided can be a depth of seal of more than about 40 mm, or more than about 50 mm, or more than about 60 mm, or more than about 70 mm. It will be appreciated any weir height can be achieved by the use of the appropriate configuration of the rigid conduit and conformable or flexible conduit components.

At each end of the conformable or flexible conduit portion 5 there is provided a substantially rigid connection member 10 for connecting or connection to a further plumbing fixture or fitting (not shown). The rigid connection member 10 can be any suitable connector, but for example may be one or more of: a threaded connector, a push-fit connector, a friction-fit connector. In an alternative, or in combination with the rigid connection member 10, there can be provided an insert for receiving a conduit in a sealing manner, for example an insert which can receive or accommodate different sized conduit (e.g. the insert can be compressible or may be arranged in a manner to receive different sized conduit).

In various embodiments, the conformable or flexible conduit portion 5 may be of a concertina-type construction, capable of extending in length from a compressed length state to a longer extended length state. In yet further embodiments, the conformable or flexible conduit may be a smooth walled conduit (i.e. does not need to be of a concertina type or bellows or of a helically wound configuration).

Figure 2:
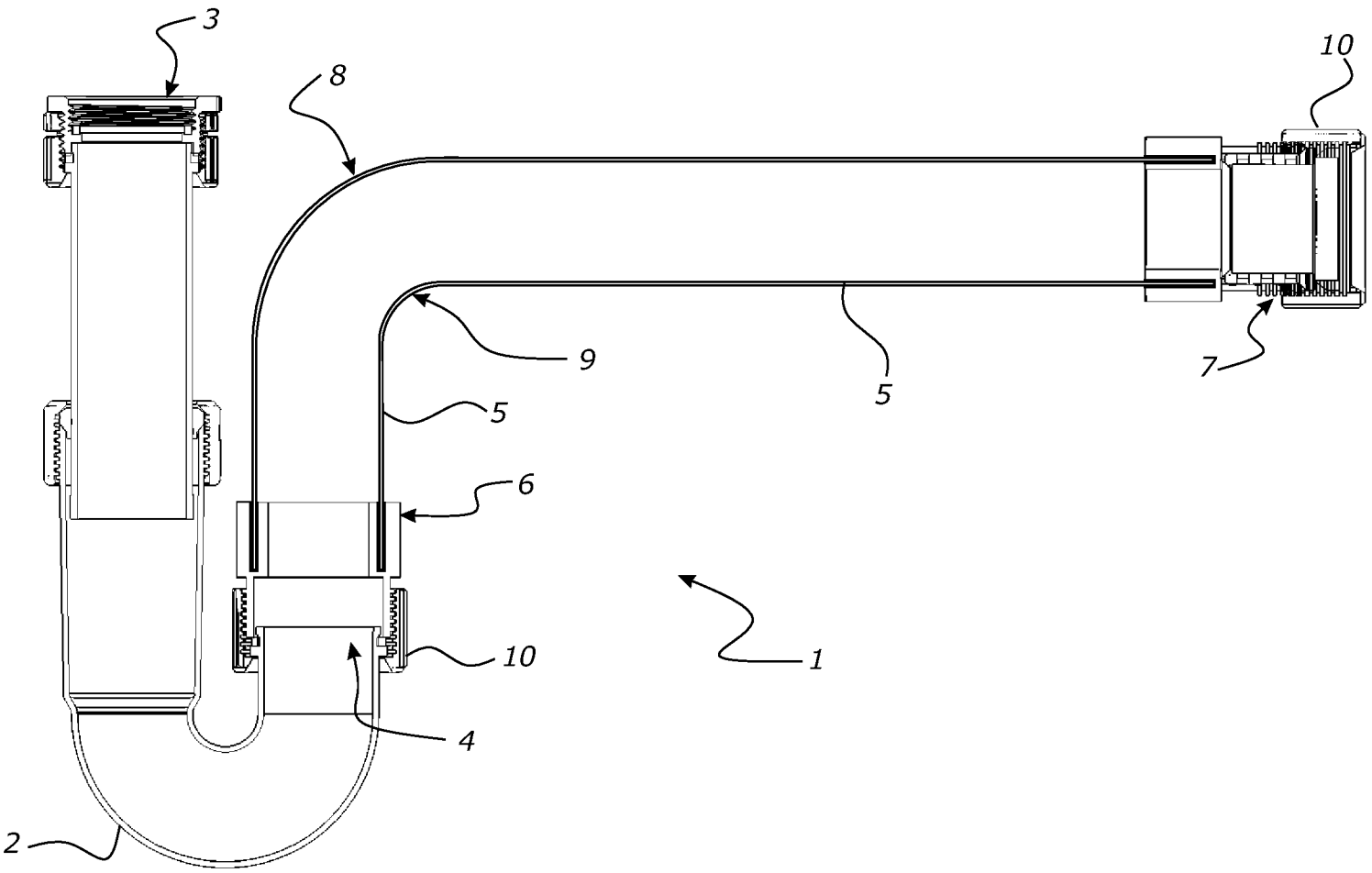
Figure 3:
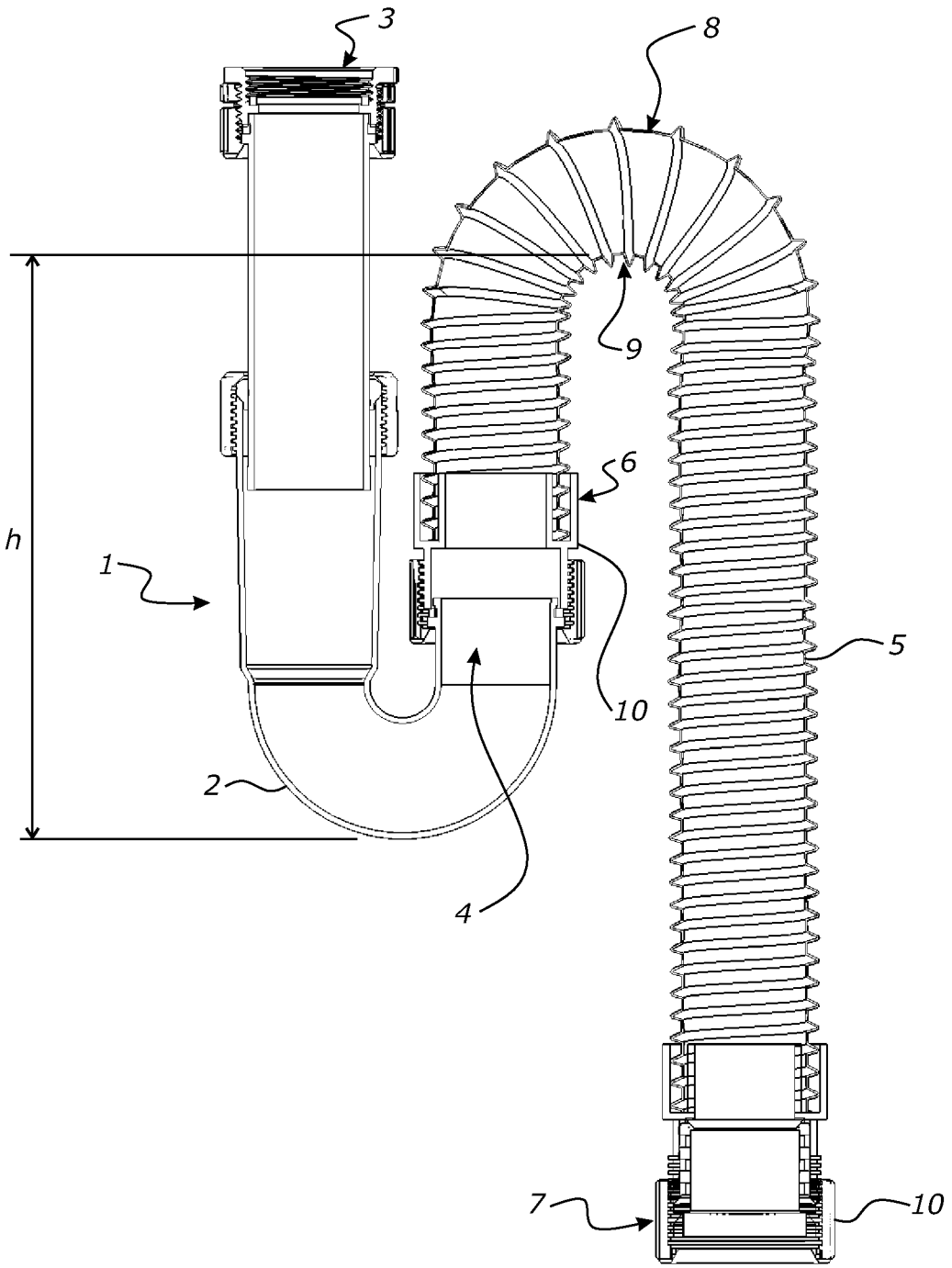
FIGS. 3 and 4 illustrate an alternative configuration of the present invention demonstrating an S-type trap assembly of a rigid component and a conformable or flexible conduit component which together, when assembled, form the trap, with FIG. 3 shown with a corrugated type conformable or flexible conduit, and FIG. 4 shown with a non-corrugated type conduit.
Figure 4:
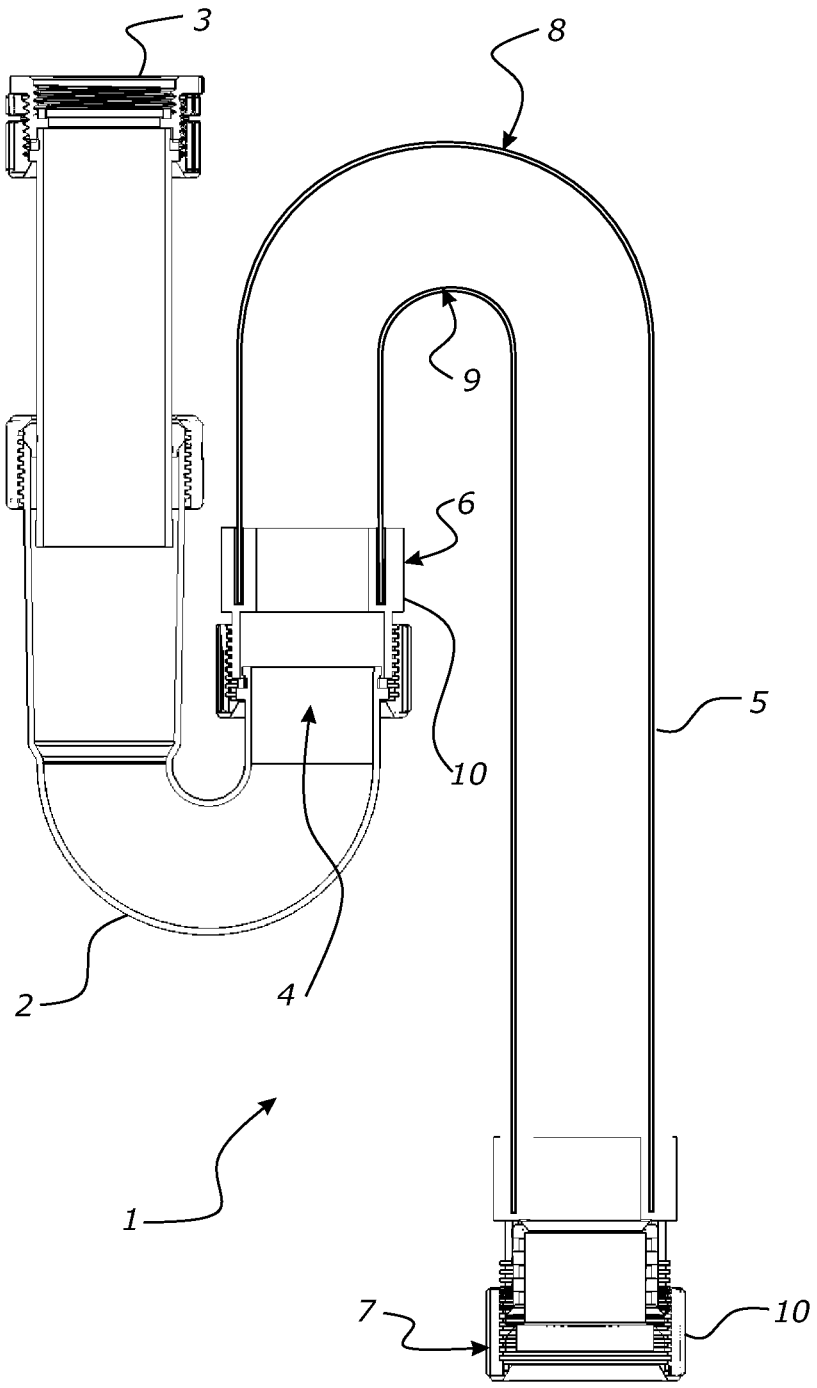

Alternatively, the conduit 5 can be of any suitable construction which enables provision of the conduit 5 which has a certain conformability or flexibility, or which when moved into a bent position, provides for a state where the bend 8 has an inner radius 9 that is at the conformable or flexible conduit's maximum compressible state. The bend 8 and inner radius shown in FIGS. 1 and 2 may be specific to those particular applications and a particular conformable or flexible conduit 5 that is used. It will be appreciated that, as shown in other figures such as 3-6 that conduit 5 of different either conformability or flexibility or of a conduit having a different maximum compressible state when in a bent condition may be used.

The conformable or flexible conduit 5 in some variations can include a reinforcing material or structure (shown shown). In this manner, the conduit 5 may have enhanced ability to conform to a desired shape, or the desired shape may be retained by the conduit once conformed or flexed to that desired shape or into a certain position.

Conduit of this invention is preferably of a material which is suitable to the application. For example, PVC conduit may be particularly preferably in commercial or residential plumbing applications, although it will be appreciated that conduit of different material characteristics may be provided depending on the application or intended use. For example, in industrial or automotive or aerospace applications the materials will need to be selected to comply with requirements or standards or safety provisions, or be able to cope with elevated or reduced temperatures of the types of liquid waste the conduit may come into contact with. Such material characteristics apply to both the rigid conduit 2 as well as the conformable or flexible conduit 5.

With respect to the invention described herein, the rigid conduit portion 2 and the conformable or flexible conduit portion 5 are provided as separate components. When assembled, these components together provide for the whole of a trap or a complete trap assembly.

In another embodiment of the invention, there is provided a conformable or flexible conduit portion 5 comprising at a first end a first coupling for connection to a first plumbing fitting or fixture, and at a second end a second coupling for connection to a partial trap portion, at either of i) an inlet to the partial trap portion, or ii) an outlet to/from the partial trap portion.

Figure 5:
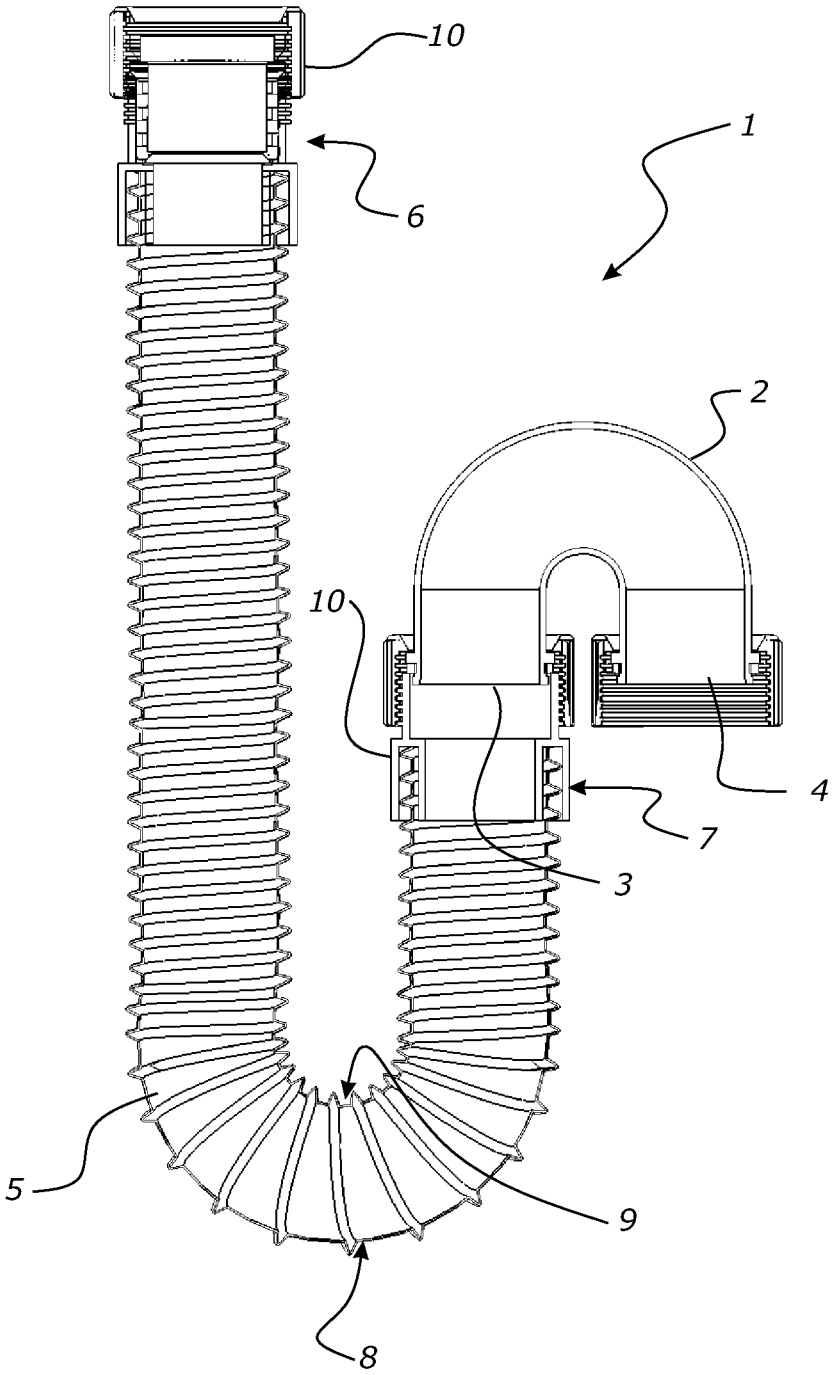
FIGS. 5 and 6 illustrate a further configuration of the invention, demonstrating another configuration in the formation of an S-type trap, FIG. 5 showing use with a corrugated type conformable or flexible conduit and FIG. 6 with a non-corrugated type conformable or flexible conduit.
Figure 6:
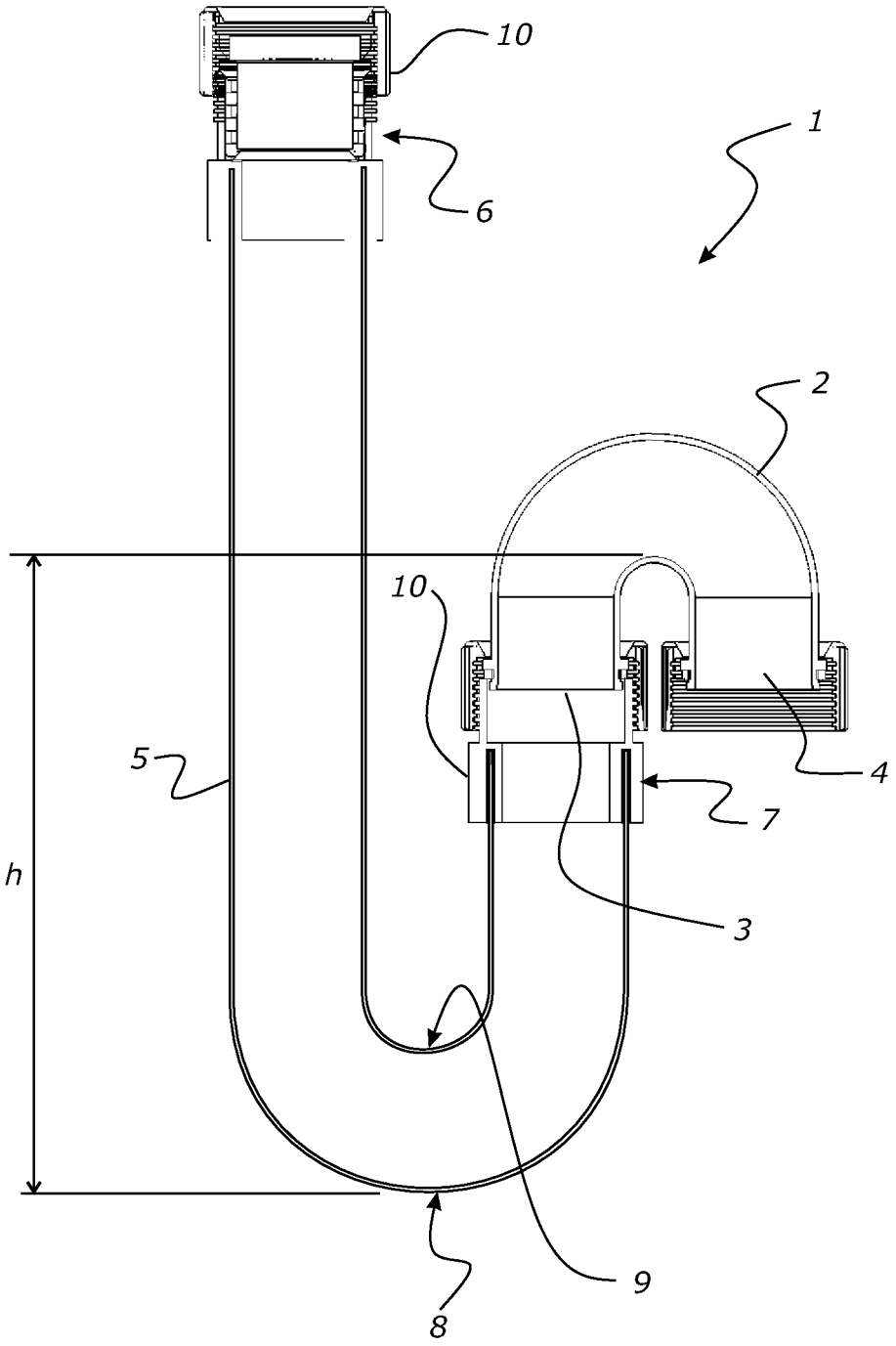

For example, FIGS. 5 and 6 illustrate a configuration where the conformable or flexible conduit 5 has one end connected to a fixture of fitting (e.g. the waste outlet from a sink—not shown), and where the other end of the conduit 5 is connected to the inlet of a partial trap portion (i.e. the rigid component 2). It will be appreciated that FIGS. 1-4 illustrate a configuration where the conformable or flexible conduit 5 is connected to the outlet of the partial trap (i.e. outlet of rigid component 2).

Again, the invention provides for the conformable or flexible conduit portion to be assembled to a substantially rigid partial trap portion to form a complete or whole trap as part of a plumbing assembly.

The first and second couplings can be a rigid connection member 10 as previously described. For example, the first and second couplings may be one or more of: a threaded connector, a push-fit connector, a friction-fit connector. As noted above, an insert may also be provided at or within each of the ends of the conduits for receiving or being coupled or connected to a further fitting or fixture. Such an insert (not shown) can be used to receive and seal with different conduit diameters.

The characteristic of the conformable or flexile conduit are those as previously discussed, including: maximum bending capability or a maximum bendable state or maximum compressible state, the type of conduit (e.g. corrugated, extendible or non-corrugated or including additional components or structural reinforcement or reinforcing members), material properties of the rigid and conformable or flexible conduit components (e.g. depending on intended use or application).

In yet a further embodiment there is provided a plumbing assembly 1 for connecting a discharge connection of a fixture to a waste outlet. Such an assembly includes a conduit comprising a first portion and a second portion. The first portion, such as a conformable or flexible conduit, comprises an entry and an outlet operable to retain a body of water between the entry and outlet, where the entry is adapted to connect to the discharge of the fixture. The second portion, such as the rigid conduit, comprises an entry and an outlet, where the entry is adapted to connect to the outlet of the first portion and the outlet is adapted to connect to the waste outlet.

Like the above embodiments and accompanying description, the plumbing assembly 1 comprises an internal passage operable to provide a fluid passage from the fixture to the waste outlet. Such an internal passage being the lumen of the conduit providing fluid communication from the outlet of a fixture or fitting to the waste outlet.

In yet another embodiment, the plumbing assembly 1 is for connecting a discharge connection of a fixture to a waste outlet. The assembly 1 comprises assembly of a rigid tube portion operable to receive water from the fixture and provide a water trap, with a flexible tube portion operable to fluidly couple water (or liquid waste) from the rigid tube portion to the waste outlet, wherein the flexible tube portion is adapted to flex to form a shape when installed and be resilient to changes in that shape caused by internal water flow.

The above description of the invention provides for an assembly of components which allows for a trap to be provided. Such a trap can be more easily assembled by an installer given the conformable or flexible nature of at least one of the components used to form the trap. Alternatively or in addition, whilst the rigid component provides for a first part or portion (i.e. a partial part) of a trap to be assembled, the conformable or flexible conduit provides for the remainder of the parts or portions needed to a whole or complete trap to be provided. The conformability or flexibility of the conduit 5 allows for certain trap configurations to be attained at the desired of the installer.

Advantageously, the conduit 5 has a certain conformance or flexible nature which limits the maximum bend of the conduit 5. In this manner, the bend 8 with the inner minimum radius 9 as shown in the figures may be provided at the maximum compressible state of the conduit 5. Such a conduit 5 is provided so that a user when installing the assembly 1 is provided with a first rigid component 2 which provides for a first part or portion of a trap to be assembled. The conduit 5 then provides for the remainder of the trap.

The conduit 5 by virtue of its nature allows a user to conform the conduit 5 into the desired shape or configuration for a trap, yet the conduit is resistive to being bent or conformed to bent states more than a maximum compressible state required for the trap to be formed (i.e. a home handy man can attach the flexible conduit 5, bend the conduit 5 about or through 90° or 180° to provide for the desired trap configuration). Depending on the conduit 5 selected, such a conduit 5 may only allow for a maximum 90° bend or a 180° bend.

The foregoing description of the invention includes preferred forms thereof. Modifications may be made thereto without departing from the scope of the invention.

The invention claimed is:

1. A plumbing assembly for connecting a discharge connection of a fixture to a waste outlet, the assembly comprising:

an upstream rigid conduit trap portion, the rigid conduit trap portion including a U-shaped form and comprising a fitting, and an inlet for coupling to a fixture, the inlet operable to receive water or liquid waste from the fixture, and an outlet, operable to discharge the water or liquid waste, the inlet comprising an extendable portion extending from the fitting;

a downstream conformable or flexible conduit portion connectable to the outlet of the rigid conduit trap portion;

wherein, when connected, the upstream rigid conduit trap portion and the downstream conformable or flexible conduit portion provide for a complete trap assembly, the complete trap assembly providing for a minimum weir height;

wherein the extendable portion is configured to extend away from an end of the downstream conformable or flexible conduit portion;

wherein a pre-determined maximum bending capability or a maximum bendable state of the conformable or flexible conduit portion defines a minimum inner bend radius, downstream of the outlet of the rigid conduit trap portion, the minimum inner bend radius and a lowest level of the rigid conduit trap portion defining the minimum weir height as more than about 50 mm; and wherein the conformable or flexible conduit portion and the extendable portion are configured to be repositioned relative to the rigid conduit trap portion, and repositioning of the conformable or flexible conduit portion and the extendable portion relative to the rigid conduit trap portion is configured to change the minimum weir height.

2. The assembly as claimed in claim 1, wherein the conformable or flexible conduit portion comprises a first end and a second end, one of the ends connectable to the rigid conduit trap portion and the other of the ends connectable to a further plumbing fixture.

3. The assembly as claimed in claim 2, wherein the first end defines an inlet to the conformable or flexible conduit portion, and the second end defines an outlet from the conformable or flexible conduit portion.

4. The assembly as claimed in claim 1, wherein the rigid conduit trap portion provides for at least a part of a whole trap, and wherein the conformable or flexible conduit portion is at least one or more of conformed or bent or shaped or flexed to provide the remainder of a desired trap configuration or shape.

5. The assembly as claimed in claim 1, wherein the minimum weir height is a pre-determined height.

6. The assembly as claimed in claim 5, wherein the minimum weir height is at least a depth of seal of about 70 mm (±5 mm), or at least about 75 mm (±5 mm), or wherein the minimum weir height is a depth of seal of more than about 50 mm, or more than about 60 mm, or more than about 70 mm.

7. The assembly as claimed in claim 2, wherein the conformable or flexible conduit portion comprises at each of the first and second ends a rigid connection member for connection to the rigid conduit trap portion, or to a further plumbing fixture.

8. The assembly as claimed in claim 7, wherein the rigid connection member is one or more of: a threaded connector, a push-fit connector, a friction-fit connector.

9. The assembly as claimed in claim 1, wherein the conformable or flexible conduit portion is of a concertina-type construction, capable of extending in length from a compressed length state to a longer extended length state.

10. The assembly as claimed in claim 1, wherein the conformable or flexible conduit portion comprises a reinforcing material or structure, such that the conformable or flexible conduit portion may be conformed to a desired shape, or the desired shape may be retained by the conformable or flexible conduit portion once conformed or flexed to a desired shape or position.

11. A plumbing assembly for connecting a fixture to a waste outlet, the plumbing assembly comprising:

an upstream rigid conduit trap portion comprising:

a rigid conduit comprising:

a rigid conduit inlet operable to receive waste from the fixture; and a rigid conduit outlet operable to discharge the waste;

a U-shaped trap comprising:

a trap inlet operable to receive the waste from the rigid conduit, the trap inlet comprising a trap inlet straight portion, the trap inlet configured to receive the rigid conduit such that the rigid conduit outlet is repositionable within the trap inlet straight portion;

a trap outlet operable to discharge the waste; and a first bend surface located between the trap inlet and the trap outlet; and a fitting configured to be coupled to the U-shaped trap when the rigid conduit is received within the trap inlet and such that the rigid conduit is coupled to the U-shaped trap; and a downstream non-rigid conduit portion configured to be coupled to the trap outlet and operable to receive the waste from the U-shaped trap, the downstream non-rigid conduit portion configured to cooperate with the U-shaped trap to provide a minimum weir height when the downstream non-rigid conduit portion is coupled to the U-shaped trap and the downstream non-rigid conduit portion provides a second bend surface, the minimum weir height being more than about 50 mm and being defined between the first bend surface and the second bend surface, the downstream non-rigid conduit portion configured to be repositioned relative to the U-shaped trap when the downstream non-rigid conduit portion is coupled to the U-shaped trap so as to facilitate adjustment of the minimum weir height.

* * * * *